US006631813B1

(12) United States Patent
Walter et al.

(10) Patent No.: US 6,631,813 B1
(45) Date of Patent: Oct. 14, 2003

(54) ARRANGEMENT FOR HANGING ARTICLES OR FOR FIXING A RACK

(75) Inventors: Herbert Walter, Müllheim (DE); Manfred Uecker, Rheinfelden (DE)

(73) Assignee: Visplay International AG, Muttenz (CH)

( * ) Notice: Subject to any disclaimer, the term of this patent is extended or adjusted under 35 U.S.C. 154(b) by 0 days.

(21) Appl. No.: 09/913,078

(22) PCT Filed: Nov. 17, 2000

(86) PCT No.: PCT/CH00/00618

§ 371 (c)(1),
(2), (4) Date: Aug. 9, 2001

(87) PCT Pub. No.: WO01/43599

PCT Pub. Date: Jun. 21, 2001

(30) Foreign Application Priority Data

Dec. 17, 1999 (DE) ..... 299 22 163 U

(51) Int. Cl.[7] ..... A47F 5/08

(52) U.S. Cl. ..... 211/94.01; 211/90.01; 211/123

(58) Field of Search ..... 211/90.01, 90.02, 211/94.01, 105, 204, 123; 108/108

(56) References Cited

U.S. PATENT DOCUMENTS

| | | | |
|---|---|---|---|
| 2,516,907 | A | 8/1950 | Penfold |
| 3,639,950 | A | 2/1972 | Lutz et al. |
| 4,223,862 | A | 9/1980 | Doughty |
| 4,308,961 | A | 1/1982 | Kunce |
| 4,316,547 | A | 2/1982 | Varon |
| 4,817,538 | A | 4/1989 | Michaelsen |
| 4,989,815 | A | 2/1991 | McAuley |
| 5,100,075 | A | 3/1992 | Morand |
| 5,109,992 | A | 5/1992 | Miller |
| 5,125,518 | A | 6/1992 | Ward |
| 5,186,341 | A | 2/1993 | Zeid |
| 5,301,912 | A | 4/1994 | Chang |
| 5,485,933 | A | 1/1996 | Crooymans |
| 5,961,082 | A | 10/1999 | Walter |
| 6,085,916 | A | 7/2000 | Kovacevic et al. |
| 6,182,937 | B1 | 2/2001 | Sanderse |

FOREIGN PATENT DOCUMENTS

| | | |
|---|---|---|
| CH | 650137 | 7/1985 |
| DE | 3438759 | 7/1985 |
| DE | 3803829 | 8/1989 |
| DE | 19702620 | 7/1998 |

(List continued on next page.)

OTHER PUBLICATIONS

Kesseböhmer GmbH, Bad Essen, Germany, "Linero® –System 2000 . . . für Nischen mit Profil", 1996, front cover, pp. 3–4, 6, 9, back cover.

German Design Reg. No. M 96 00218, German Geschmacksmusterblatt Heft 19 Vom Oct. 10, 1996, pp. 4981–4988.

*Primary Examiner*—Daniel P. Stodola
*Assistant Examiner*—Erica B. Harris
(74) *Attorney, Agent, or Firm*—Selitto, Behr & Kim

(57) ABSTRACT

An arrangement for hanging and displaying articles or for securing a receiving member for supporting and displaying articles thereon comprises a plug-in mount that is inserted into a supporting structure, and a support that is plugged into the plug-in mount. The support has at least one tongue that is plugged into a passage provided in the plug-in mount and articles may be hung directly from the support. Alternatively, the support is in the form of a shelf, of which the rear border can be plugged into the passage of the plug-in mount and upon which articles may be supported and displayed. The arrangement is suitable as a fitting for a single hanging member and for the construction of a complex display surface on a plurality of planes located one above the other and one behind the other, and allows individual design and variable utilization.

17 Claims, 10 Drawing Sheets

FOREIGN PATENT DOCUMENTS

| | | |
|---|---|---|
| DE | 29903019 | 6/1999 |
| EP | 0332377 | 9/1989 |
| EP | 0519349 | 12/1992 |
| EP | 0568158 | 11/1993 |
| EP | 0716825 | 6/1996 |
| EP | 0791315 | 8/1997 |
| EP | 0834274 | 4/1998 |
| FR | 1293293 | 5/1961 |
| FR | 2611468 | 9/1988 |
| GB | 2133685 | 8/1984 |
| GB | 2206033 | 12/1988 |
| GB | 2222070 | 2/1990 |
| GB | 2224923 | 5/1990 |
| GB | 2241426 | 9/1991 |
| WO | 9114388 | 10/1991 |
| WO | 9618329 | 6/1996 |
| WO | 9622469 | 7/1996 |
| WO | 9726809 | 7/1997 |
| WO | 9920094 | 4/1999 |

Fig. 4B
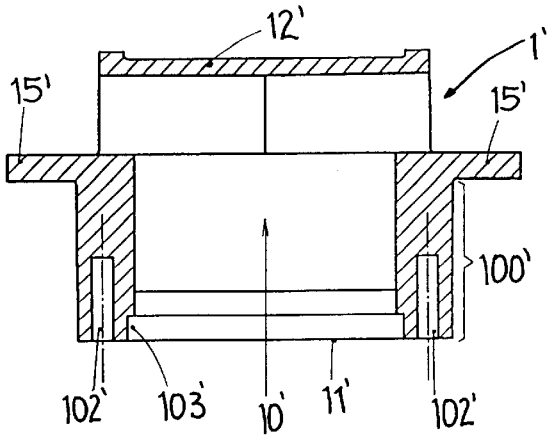
Fig. 4C
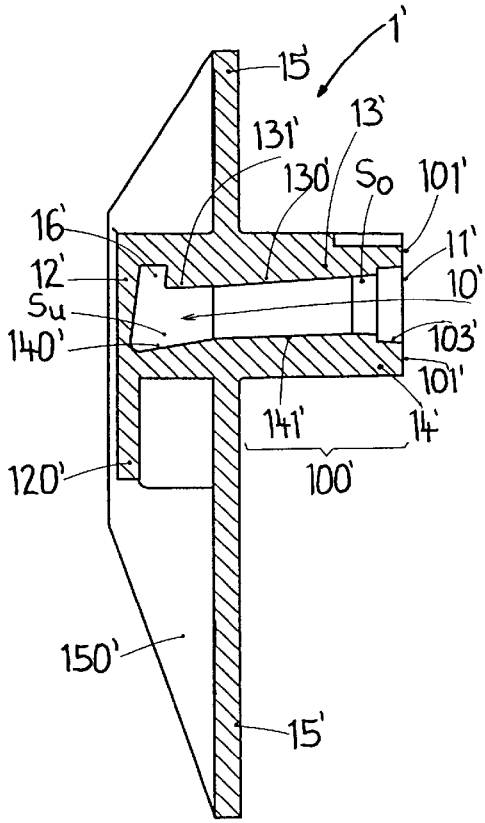
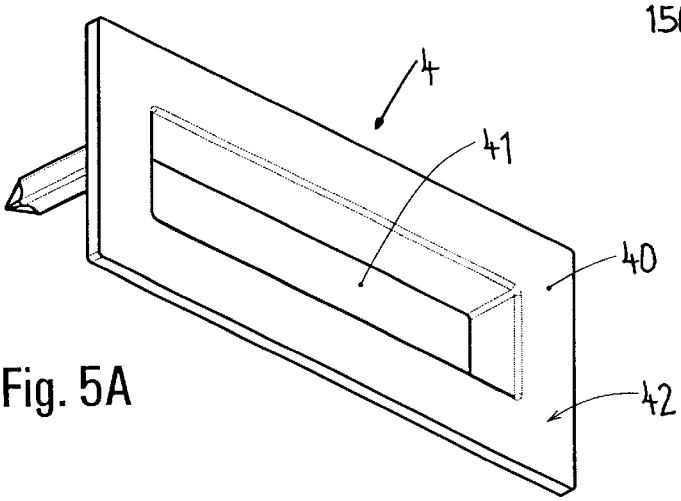
Fig. 5A
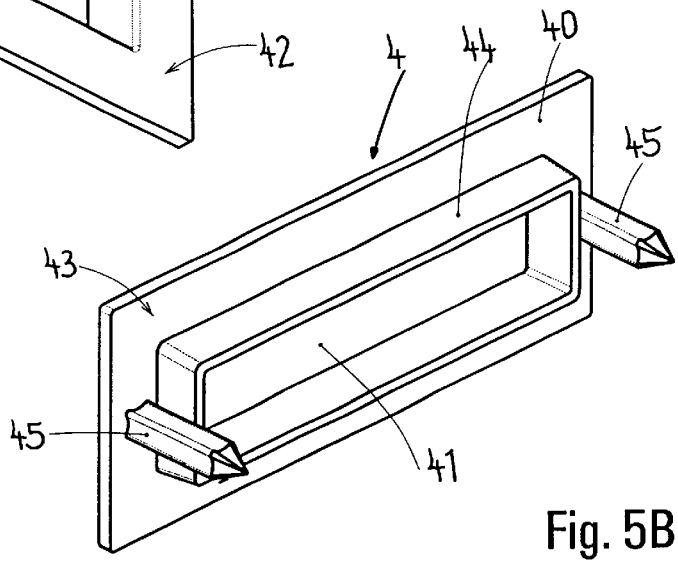
Fig. 5B

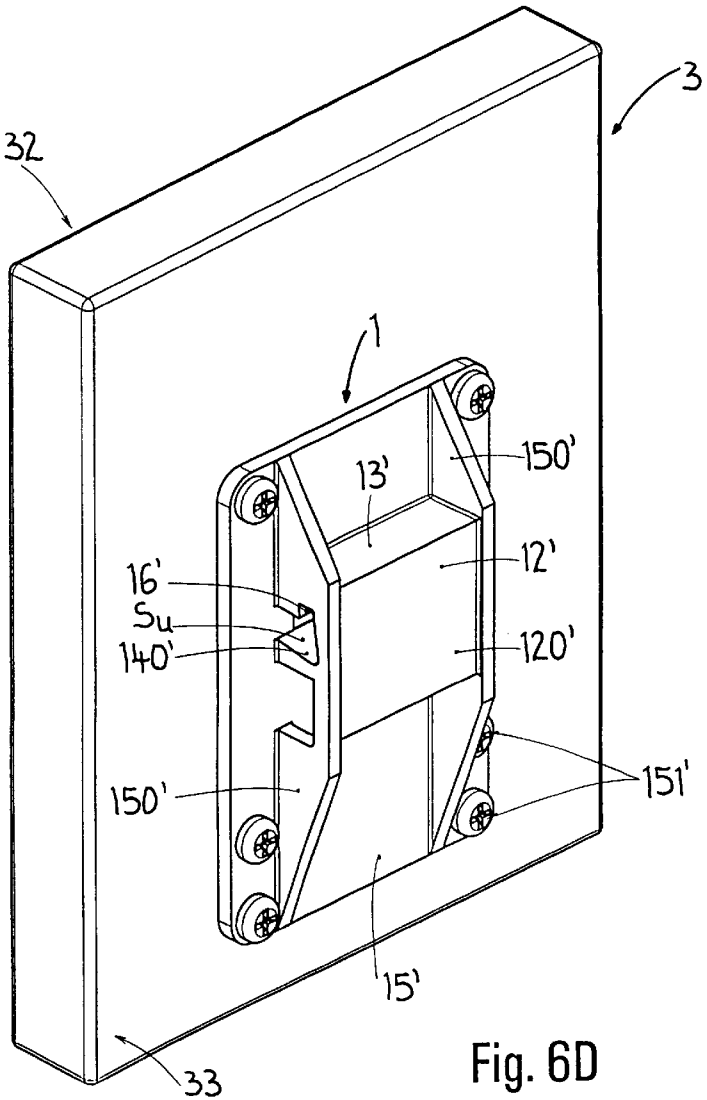
Fig. 6D
Fig. 6C
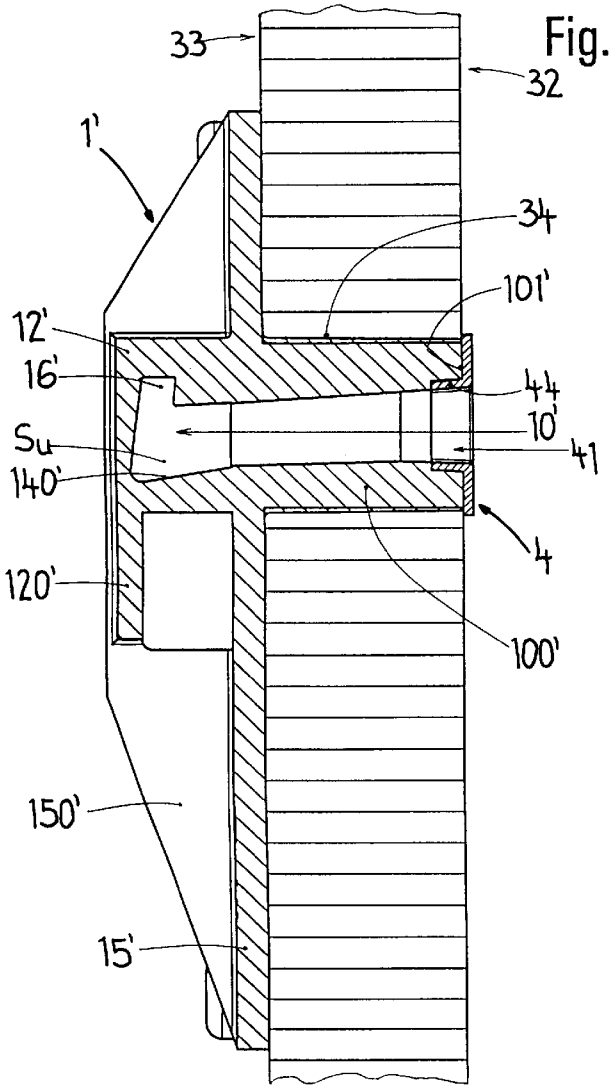

ARRANGEMENT FOR HANGING ARTICLES OR FOR FIXING A RACK

APPLICATION AREA OF THE INVENTION

The present invention relates to an arrangement for hanging articles or for securing a receiving means for supporting and displaying articles thereon, wherein the articles may be, for example, goods for sale, items for commercial or private use, exhibition exhibits or decorative elements.

PRIOR ART

A supporting-bar structure is known, for example, from U.S. Pat. No. 4,316,547. Running on a vertical wall are two vertical, spaced-apart rails with a grid arrangement of holes, where in each case one short rail element can be plugged into each rail, in two holes at the same vertical level. The two rail elements project into space per-pendicularly from the rear wall, and a crossbar is positioned over the rail elements. It is possible to hang directly on the crossbar, for example, clothes hangers and support bars which project further into space and, for their part, have articles hanging on them. This supporting-bar structure is indeed vertically adjustable, but otherwise cannot be varied to any great extent as a result of the necessary rails with the grid arrangements of holes, and additionally involves relatively high outlay.

Fittings which are intended for hanging goods and have horizontally arranged profile rails are also known, for example, from WO 91 14388 and DE 38 03 829 A1. Support bars can be pushed laterally into the profile rails, or engaged by tilting, by way of their attached endpieces. This design is very material-intensive and limits the design freedom to a vast extent as a result of the profile rails, which are to be positioned on the supporting rear wall and can be seen on the outside. The profile rails are not envisaged for providing individual supporting-bar porting-bar arrangements. Furthermore, additional lateral arresting means would be necessary in order to prevent the horizontal displacement of the latched-in support bars along the profile rails and thus to maintain an ordered appearance for the sales surface even with a lot of activity taking place round about.

U.S. Pat. No. 5,109,992 discloses a supporting-bar arrangement which, in part, reduces the disadvantages of long profile rails by it being possible to fix on a rear wall short rail elements which are cut to size as plug-in mounts and into which, in each case, one support bar can be pushed laterally with the plug-in plate arranged right at the front. This arrangement would also require lateral arresting means in order to prevent the support bar, which has only been pushed in, from sliding out accidentally. Moreover, the plug-in mounts can only be positioned on rear walls, and are thus visible as an unsightly sheet-metal part and therefore not particularly suitable, for example, for aesthetically pleasing shop designs.

EP 0 519 349 B1 discloses a further supporting-bar arrangement, comprising a plug-in mount, which can be inserted into a panel, and a support bar. Each plug-in mount can be fitted with an individual support bar. The plug-in mount can be inserted into a cutout in the panel, the outer edge of the plug-in mount being positioned on the border of the cutout. The plug-in mount is retained by a top nose, which projects into the panel, and a screw-connection to the rear wall, which is located behind the panel. The plug-in mount has a slot which is bounded by a profile shoulder at the bottom and an inwardly bent buffer edge at the top, the buffer edge leaving a gap open. The support bar comprises a bar element and a tail plate which is fixed to the a rear bar end and, at the top, has a doubly angled portion, the horizontal section of which is adjoined by a downwardly extending plate segment with a planar surface. In the latched-in state, the horizontal section of the angled portion is supported on the profile shoulder, while the upwardly projecting vertical section of the angled portion projects through the gap located behind the buffer edge, and the plate segment rests on the front side of the plug-in mount. If the support bar is to be disengaged, it is necessary for the support bar to be positioned obliquely in order for it to be possible for the vertical section of the tail plate to be drawn out of the gap; the latching-in operation proceeds analogously. Although this supporting bar arrangement better fulfils the aesthetic requirements, does not require any rail material and makes it possible to fit out an arrangement of plug-in mounts quickly, a series of disadvantages still remains. First of all, the plug-in mount can only be inserted into a cutout in the panel, but cannot be positioned on the panel or arranged on the rear side of the same. The greatest drawback is that the support bars can be disengaged very easily by being raised at the front, which may be brought about merely by them being knocked. Furthermore, the inner contour of the plug-in mounts and the doubly angled portion of the tail plates result in the plug-in mounts and tail plates involving relatively high outlay to produce.

EP 0 716 825 B1 relates to a supporting-bar arrangement with a housing-like plug-in mount with inner undercuts. The window-like plug-in opening, which serves for accommodating the plug-in plate of a support bar, is enclosed by a positioning flange. The following variants are envisaged for the installation of the plug-in mount: a) positioning on the supporting structure from the front; or b) positioning on the supporting structure from the rear; or c) insertion into the supporting structure. In the case of variant a), the plug-in mount, with its frame-like covering, is seated, as a cuboidal housing, in a raised manner on the front side of the supporting structure. For design reasons, this variant of the arrangement of the plug-in mount is only possible for certain applications since the plug-in mounts are clearly visible, look conspicuous and disrupt the even proportioning, for example, of a display wall with multiple fittings. In the case of variant c), the plug-in mount is inserted into the supporting structure, the frame-like positioning flange being positioned on the front side of the supporting structure and thus likewise being the dominant feature over a relatively large surface area. The variant b) requires additional work since, for the rear-side positioning of the plug-in mount, the through-passage through the supporting structure has to be cut very precisely because it can be seen from the front. Moreover, it is possible to see the cut edges in the through-passage.

Finally, the designs from DE 299 03 019 U1 and WO 99/20094 are also known, these providing merely for supporting arms to be fitted or plugged into a profile rail or a plug-in sleeve, respectively.

OBJECT OF THE INVENTION

In summary, it should be stated that the hitherto known arrangements fulfil the practical requirements better and better. The object of the invention, however, is, by further developing the design, to render the visual appearance of the arrangement in the installed state even more discreet. Moreover, the intention is to extend the variability and design freedom in order for it to be possible to construct straightforward but also individual, complex structures. It has to be possible, with as little work as possible, during the installation for the plug-in mount to be inserted into a supporting structure, e.g. a rear wall, a panel or a rack element, and fixed.

The intention is for it to be possible for differently configured supports to be plugged straightforwardly into a plug-in mount, and the displacement within the plug-in mount or the changeover to another plug-in mount is to be just as straightforward. For more complex constructions, the intention is for it to be possible for a multiplicity of plug-in mounts to be positioned systematically in a plurality of planes which are horizontal, vertical and located spatially one behind the other. It is also intended for it to be possible for receiving means, such as shells or open boxes, to be installed on a plurality of supports. It is necessary for the individual plug-in supports to be arrested in a stable manner in the plug-in mounts without additional securing measures, even when the support, projecting into space, is inclined downward and subjected to relatively high loading. Plug-in mounts which have been inserted in a supporting structure but are not fitted with a support, must not adversely affect the aesthetic appearance.

OVERVIEW OF THE INVENTION

The arrangement serves for hanging articles or for securing a receiving means. The arrangement comprises a plug-in mount, which can be inserted into a supporting structure, and a support, which can be plugged into the plug-in mount. The plug-in mount has a passage which extends between a front inlet and a rear boundary. The passage has, at the top, a bevel which slopes upward, in the direction of the inlet, and thus forms a top clearance. At the bottom, the passage has an inclination which slopes downward, in the direction of the boundary, and thus forms a bottom clearance. The passage also has, at the top, an undercut which is arranged upstream of the boundary in the direction of the inlet. A horizontally fitted profile rail or a housing for forms an alternative embodiment of the plug-in mount. The support has at least one tongue which can be plugged into the passage of the profile rail or of the housing and has an upwardly directed hook which is intended for engagement in the undercut. Alternatively, the support is in the form of a shelf, of which the rear border can be plugged into the passage of the profile rail.

Specific embodiments of the arrangement are described hereinbelow: a longitudinal groove is provided in the bottom of the passage of the profile rail, a preferably elastic extruded profile being seated in said longitudinal groove as a slipping-prevention means. The rear border of the plugged-in shelf-like support or the tongue of the support rests on the extruded profile by way of the underside in each case. The passage of the profile rail is enclosed by a top strut, a bottom strut and a base plate as the rear boundary. The top strut has the undercut, a bearing means, which is arranged upstream of the undercut in the direction of the inlet and, right at the front, the upwardly sloping bevel with the top clearance located therebeneath. The bottom strut has the inclination, with the bottom clearance located above, and a bearing means, which is arranged upstream in the direction of the inlet and has the longitudinal groove. The top and bottom struts open out into the base plate.

The top and the bottom struts extend approximately as far as the front side of a supporting structure attached to the profile rail. A tongue extension projects perpendicularly in each case from the top and bottom struts, and are intended for being accommodated in grooves which are provided in the edges of attached panels. The panels form the supporting structure. An upper and a lower supporting strut open out into the base plate from the top and bottom struts, respectively. A cavity is enclosed in each case between the top strut and the associated upper supporting strut and between the bottom strut and the associated lower supporting strut. The top and bottom struts run in a conically widening manner in the direction of the vertical base plate. Provided on both sides of the base plate are continuations which extend beyond the top and bottom struts, opening out into the base plate. These continuations each have a notch line which serves for locating purposes for screw holes which may optionally be provided, it being possible for these screw holes to be utilized for fastening the construction comprising the supporting structure with one or more attached profile rails directly or indirectly on a building part. The shelf-like support is a panel, e.g. made of wood, plastic, metal or glass, in which case the panel is preferably planar and may have additional attachments.

The passage of the plug-in mount in the form of a housing is enclosed by a top strut, a bottom strut, side flanks extending between the struts, and a base plate as the rear boundary. The top strut has the undercut, a bearing means, which is arranged upstream of the undercut in the direction of the inlet, and, right at the front, the upwardly sloping bevel with the top clearance located therebeneath. The bottom strut has the inclination, with the bottom clearance located above, and a bearing means, which is arranged upstream in the direction of the inlet. The top and the bottom struts, with the side flanks, form a sleeve element which, inserted into a through-passage opening of a supporting structure, extends approximately as far as the front side of the supporting structure. The housing has a positioning flange which is located downstream of the inlet and is intended for abutting against the rear side of the supporting structure.

The positioning flange has screw holes for fastening on the rear side of the supporting structure and, on its rear side, has ribs which serve for reinforcement and possibly accommodating a support. The positioning flange or the base plate, on its rear side, has a fastening element for rear-fastening purposes. Openings are provided on the front edge of the sleeve element, and a groove is provided in the passage, inside the front edge, for the latching attachment of a frame-like covering. The covering comprises, first of all, a rectangular frame which runs round a window-like through-passage which is congruent with the inlet. The frame is planar on its front side and, positioned on the front side of the supporting structure, is intended for covering over the front edge of the sleeve element. An extension which encloses the through-passage and comes to rest in the groove is provided on the rear side of the frame. Two pegs extend from the rear side of the frame and are intended for latching into the openings.

The tongue of the support, it being possible for said tongue to be plugged into the passage, has the upwardly directed hook at its free end, and a tongue stem extends from the hook to the support. A tapered portion which runs obliquely upward in the direction of the hook is provided at the bottom of the tongue stem. The tongue preferably consists of flat material of rectangular cross section. The support constitutes a supporting arm, and the tongue stem merges into a base end, which is directed toward the tongue, of a bar part which is the fundamental constituent part of the supporting arm.

The supporting structure is formed by a rear wall, a panel or a rack element. A multiplicity of plug-in mounts may be arranged systematically on the supporting structure. The bar parts of the supporting arms may be aligned in a rectilinear or inclined manner and serve for hanging articles directly or for securing a receiving means, such as a shelf, a basket or an open or closed box. It is possible to bridge between a plurality of supports which are arranged at the same vertical level or at different vertical levels. Plug-in mounts of the same or different types may also be arranged in planes located one behind the other. Plug-in mounts in a first supporting structure thus form the background for a second supporting structure, arranged in front, in which plug-in mounts are likewise inserted. The plug-in mount in the form of the profile rail is preferably an extruded profile and in the form of the housing is preferably a molding or casting. The covering is preferably a plastic injection molding of any desired color. An elastic polymer material is a particular possibility for the extruded profile for the slipping-prevention means.

The arrangement according to the invention straightforwardly allows a support-designed as a supporting arm or in the form of a shelf—to be plugged into the plug-in mount provided and to be removed from the same. Both the profile rail and the housing, inserted from the rear side of the supporting structure, as the alternative plug-in mount, which is covered by a frame-like covering from the front side, allow very discreet installation. The arrangement is suitable as a fitting for a single hanging means right up to the construction of complex shop fittings on a plurality of planes located one above the other and one behind the other, and allows individual design and variable utilization. The rotationally fixed, play-free seating of an individual supporting arm plugged into the plug-in mount is also particularly advantageous.

BRIEF DESCRIPTION OF THE APPENDED DRAWINGS

In the drawings:

FIG. 2A shows a perspective view of the illustration according to FIG. 1A with a first embodiment of a support, in the form of a supporting arm, plugged in;

FIG. 3A shows a perspective view of the illustration according to FIG. 1A with a second embodiment of a support, in the form of a shelf, plugged in;

FIG. 4B shows the embodiment according to FIG. 4A in section along line D—D;

FIG. 4C shows the illustration embodiment according to FIG. 4A in section along line E—E;

FIG. 5A shows a perspective illustration of the front side of a covering;

FIG. 5B shows a perspective illustration of the rear side of the covering according to FIG. 5A;

FIG. 6C shows the enlarged illustration according to FIG. 6B in section along line F—F;

FIG. 6D shows a perspective rear view of the illustration according to FIG. 6B;

FIG. 7A shows a perspective view of the illustration according to FIG. 6B with a support, in the form of a supporting arm, plugged in;

EXEMPLARY EMBODIMENTS

Figure 1A:
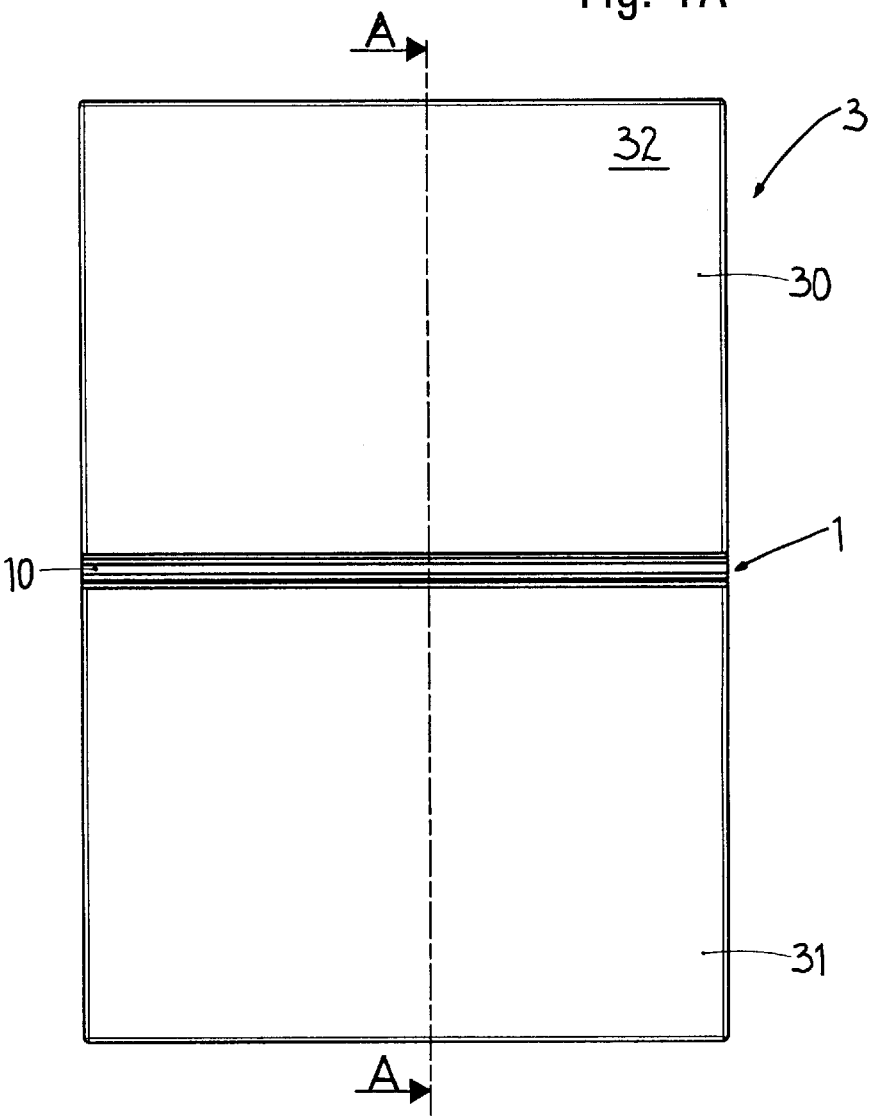
FIG. 1A shows a front view of a first embodiment of a plug-in mount, in the form of a profile rail, inserted into a supporting structure.
Figure 1B:
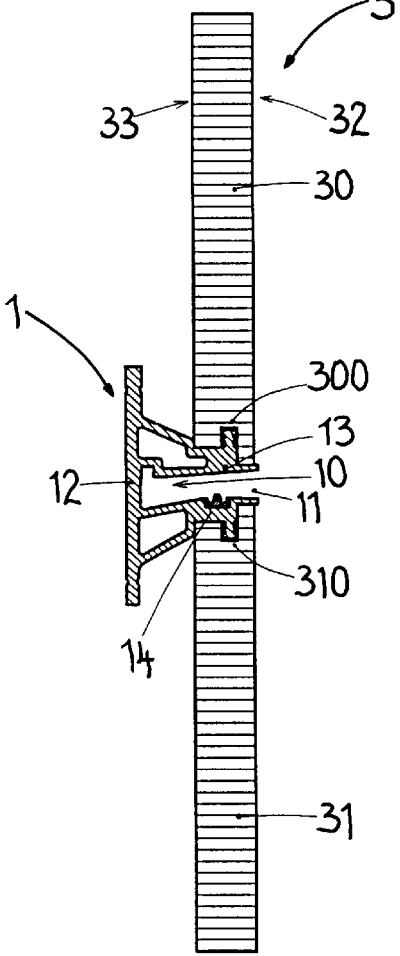
FIG. 1B shows the embodiment according to FIG. 1A in section along line A—A.

With reference to the attached drawings, the detailed description of exemplary embodiments of the arrangement according to the invention will be given hereinbelow. Possible modifications worth mentioning will be listed following the description.

The following applies to the rest of the description. If, in order to avoid ambiguity in the drawings, a figure contains designations which are not explained in the directly associated text of the description, then you are referred to the point at which they are mentioned in previous or following descriptions of the figures. For reasons of clarity, components are not usually designated again in subsequent figures, provided that it is clear from the drawings that they are "recurring" components FIGS. 1A to 2B The present invention relates to an arrangement for hanging articles or for securing a receiving means for supporting and displaying articles thereon. The present invention is suitable for use with articles including, but not limited to, goods for sale, items for commercial or private use, exhibition exhibits or decorative elements, In the first embodiment, the plug-in mount is in the form of a profile rail 1 which, in this case, is inserted horizontally into a supporting structure 3—comprising a top panel 30 and a bottom panel 31. The two panels 30,31, which are attached to the profile rail 1 from the top and from the bottom by way of their edges 300,310, together form a vertical wall surface with a front side 32 and a rear side 33. As seen in cross section, the profile rail 1 has a passage 10 which extends as a slot along the profile rail 1 and has the inlet 11, which is open in the direction of the front side 32. A base plate 12 is located, as a rear boundary, opposite the inlet 11. The passage 10 is enclosed by a top strut 13 and a bottom strut 14. Supports—in this case designed, in a first embodiment, as supporting arms 2—can be plugged into the slot-like passage 10 at any desired position along the entire profile rail 1. The supporting arms 2 comprise the bar part 20, which projects into space, and an extended portion or tongue (21), which is arranged at the base end 200 of the bar part 20 and fits in the passage 10, and thus cannot be seen. In the direction of the extreme end 201 of the bar part 20 the plugged-in supporting arm 2 tends slightly upward in relation to the horizontal, which is visually advantageous and compensates for any possible sagging in the event of high loading.

Figure 2A:
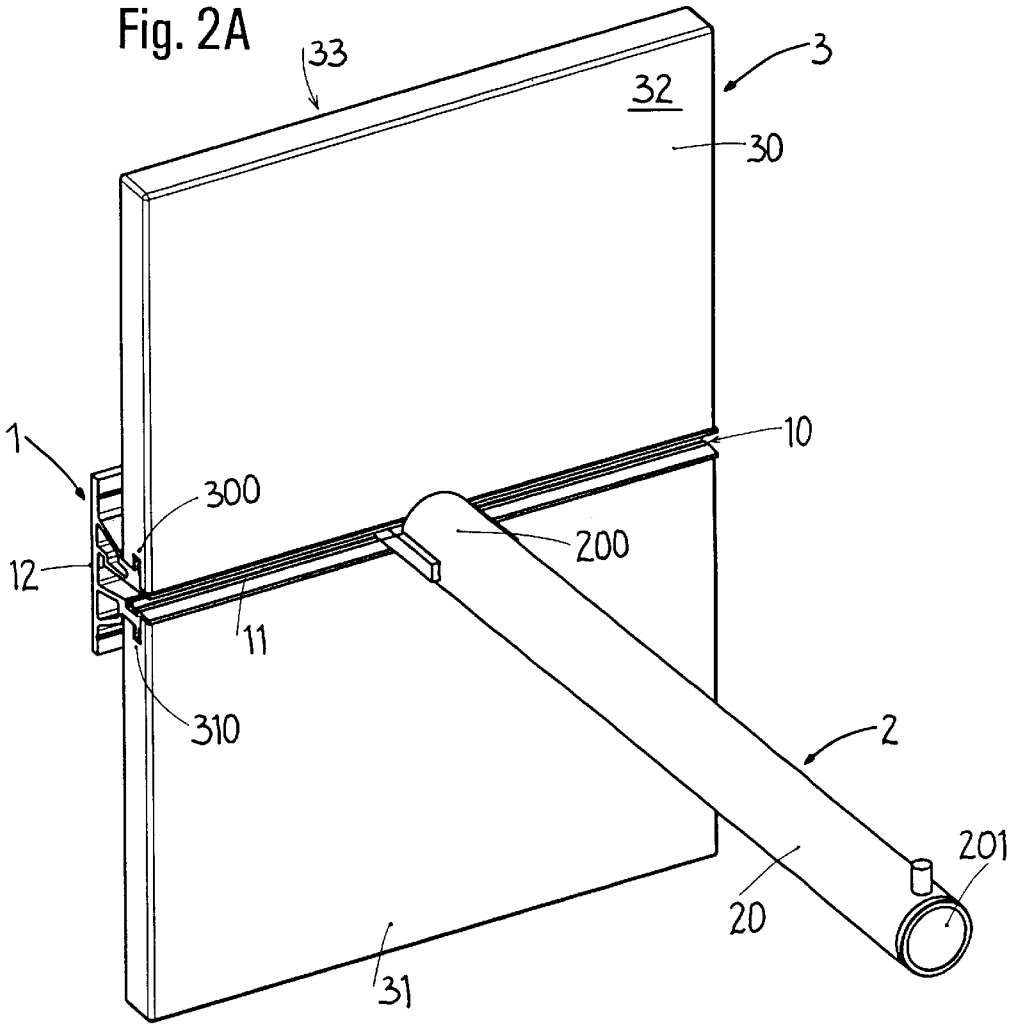
Figure 2B:
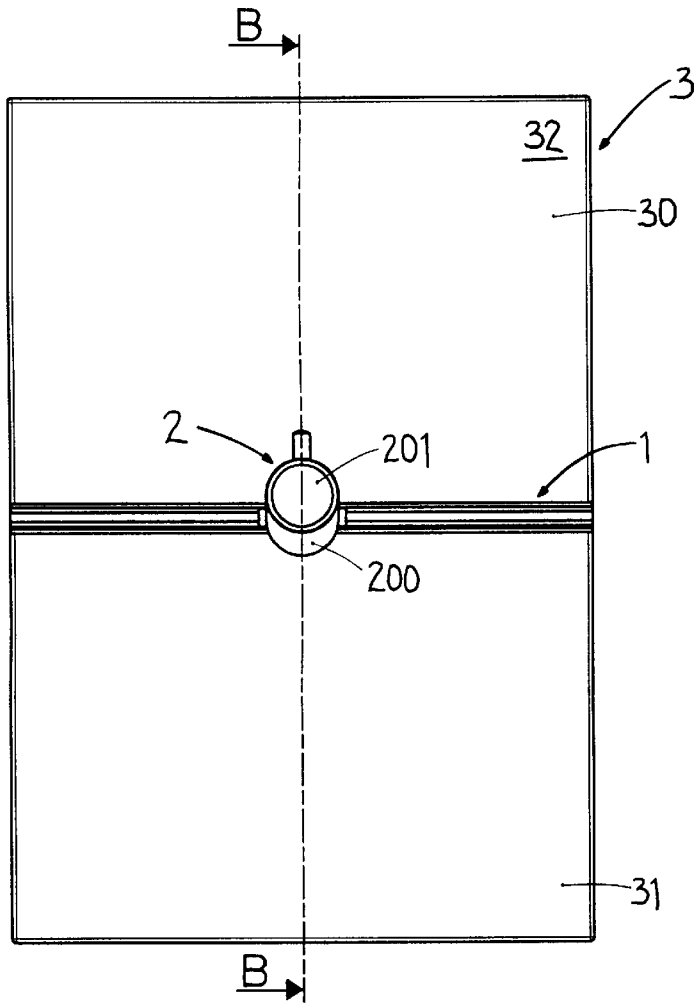
FIG. 2B shows a front view of the illustration according to FIG. 2A.
Figure 2D:
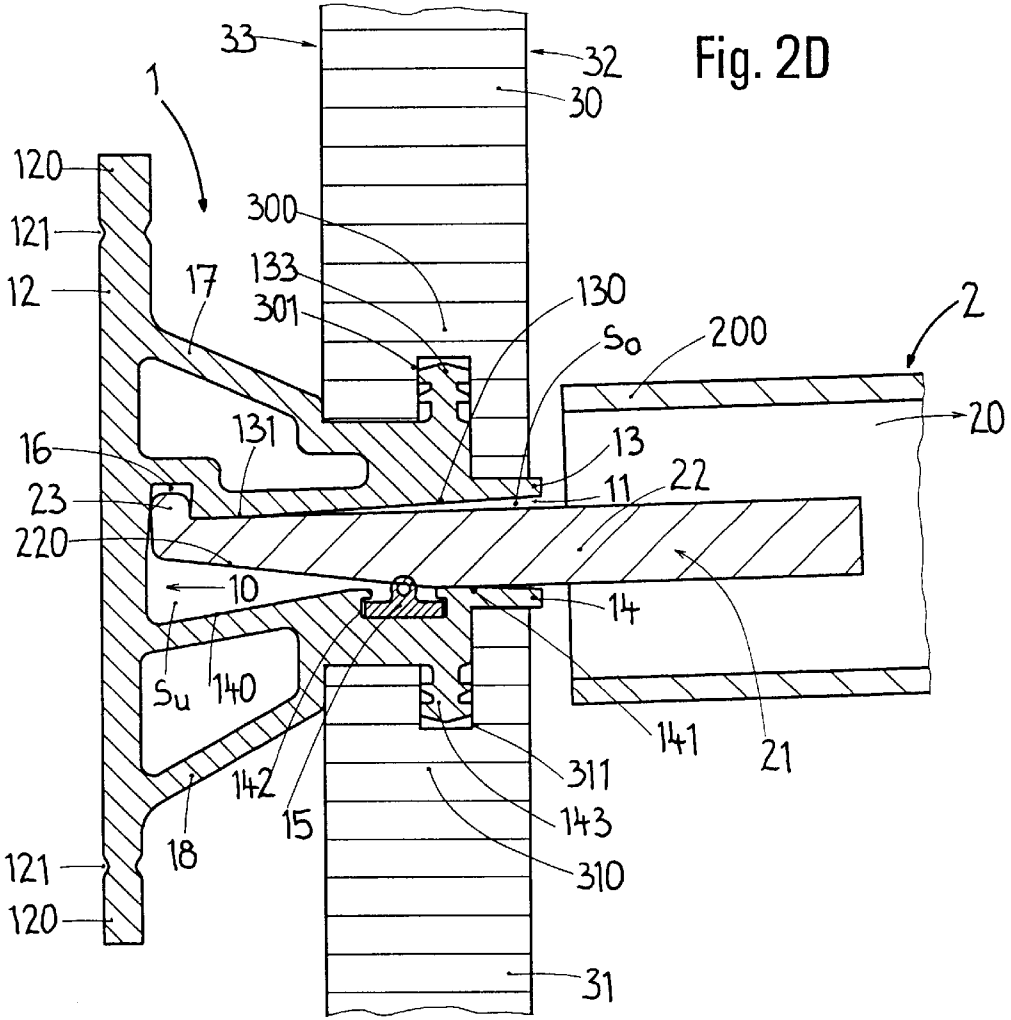
FIG. 2D shows the detail X from FIG. 2C on an enlarged scale.
Figure 2C:
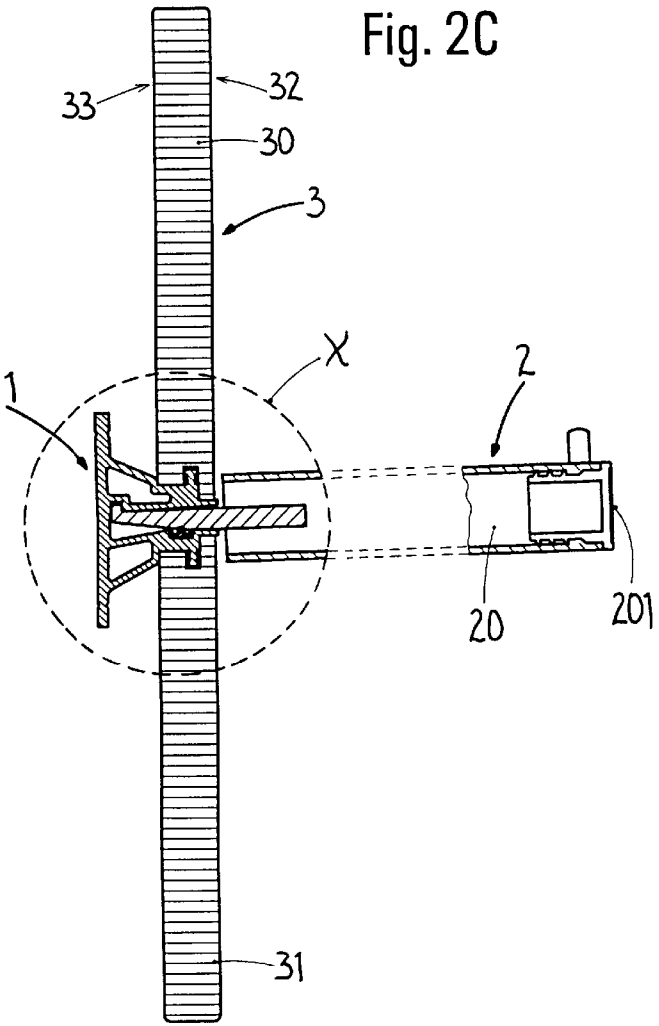
FIG. 2C shows the illustration according to FIG. 2B in section along line B—B.

FIGS. 2C and 2D

The bottom strut 14 slopes down obliquely in the direction of the base plate 12 by way of an inclination 140, as a result of which a downwardly widened clearance $S_u$ is produced in the rear region of the passage 10. Toward the front, in the direction of the inlet 11, the inclination 140 merges into a basically planar bearing means 141. Running within the bearing means 141 is a longitudinal groove 142, in which there is located an extruded profile 15, which projects out of the longitudinal groove 142 as a slipping-prevention means. Provided at the transition between the base plate 12 and top strut 13 is an undercut 16, which is followed, in the direction of the inlet 11, by a basically planar bearing means 131. This bearing means 131 merges, in the direction of the inlet 11, into an upwardly sloping bevel 130, as a result of which an upwardly widened clearance $S_o$ is produced. The passage 10 thus opens upwardly more or less in the manner of a beak at the inlet 11 and widens depthwise in the downward direction. In the installed state, the top and bottom struts 13,14 terminate approximately flush with the front side 32 of the supporting structure 3. It is visually advantageous to have a minimal projection of the top and bottom struts 13,14 beyond the front side 32; this serves as edge protection.

Extending upward from the top strut 13 and downward from the bottom strut 14 in each case is a tongue extension 133,143, these engaging in corresponding grooves 301,311 in the edges 300,310 of the panel parts 30,31. From the start of the grooves 301,311, on the struts 13,14, in each case one oblique supporting strut 17,18 runs respectively above the top strut 13 and beneath the bottom strut 14, enclosing cavities in the process, to the base plate 12. The base plate 12 extends, by way of continuations 120, vertically beyond the supporting struts 17,18, opening out in the base plate. These continuations 120 have a notch line 121 on both sides, the notch line serving as a marking, for example, for providing screw holes if the profile rail 1, together with the attached supporting structure 3, is to be fastened on a rear wall.

As a connection to the bar part 20, the tongue 21, seated at the base end 200 of the supporting arm 2, has a cross-sectionally preferably rectangular stem 22 and, at the front, an upwardly oriented hook 23. On the underside, the stem 22 has a tapered portion 220 in the direction of the hook 23. When the tongue 21 is plugged into the passage 10, it first of all has to be inclined in the forward direction, which is achieved by the supporting arm 2 being raised at the extreme end 201 of the bar part 20. In this way, the tongue 21, with the hook 23, can be pushed into the passage 10 to the full extent. This is made possible by the clearance $S_o$, which is widened in the upward direction at the inlet 11, and the clearance $S_u$ which is located beneath the undercut 16. If the hook 23 is located beneath the undercut 16, the extreme end 201 is lowered, with the result that the hook 23 moves into the undercut 16. At the same time, the stem 22 has its top side extending beneath the bearing means 131 on the top strut 13 and has its underside supported on the bearing means 141 of the bottom strut 14. In this case, the underside of the stem 22 exerts pressure on the extruded profile 15. The operation of disengaging the supporting arm 2 proceeds in reverse order and begins with it being raised at the extreme end 201, as a result of which the hook 23 moves out of the undercut 16. It is possible for the supporting arm 2 to be plugged in and disengaged at any desired location along the entire profile rail 1. With the extreme end 201 raised slightly, it is also possible for the supporting arm 2, by way of the tongue 21 sliding transversely in the passage 10, to be displaced into a different position without it being necessary for the supporting arm 2 to be disengaged to the full extent.

Figure 3B:
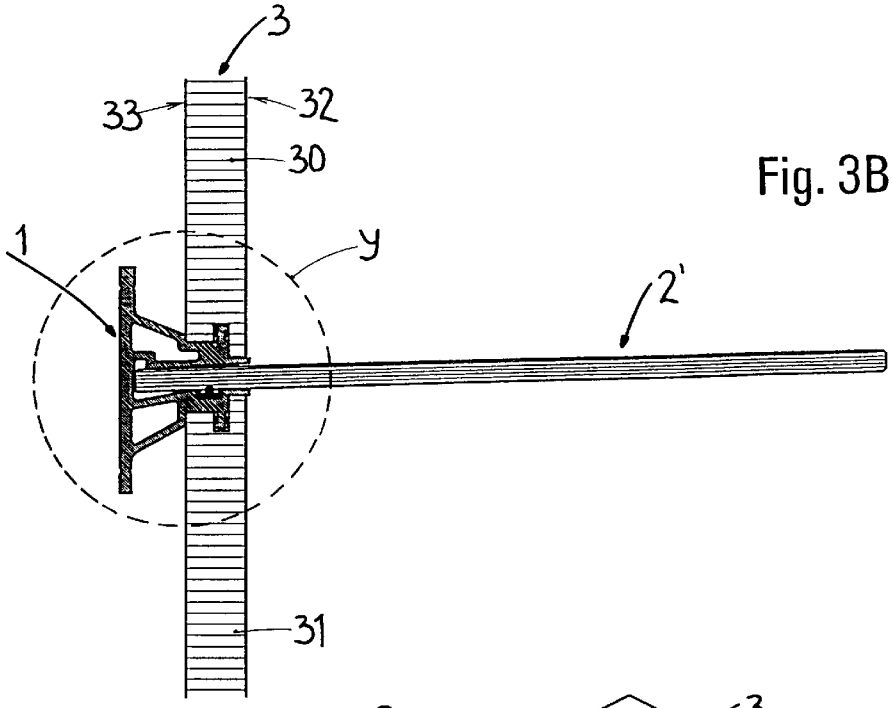
FIG. 3B shows the embodiment according to FIG. 3A in section along line C—C.
Figure 3A:
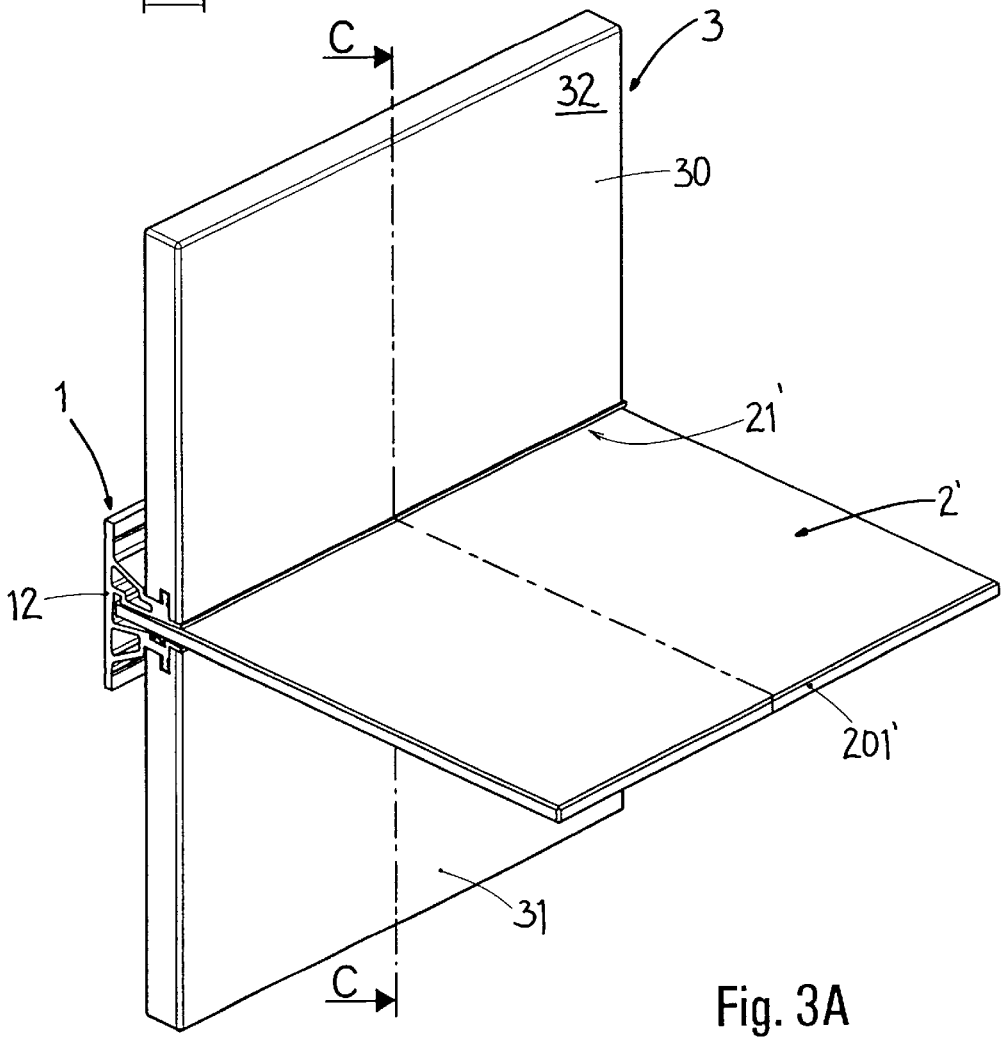
Figure 3C:
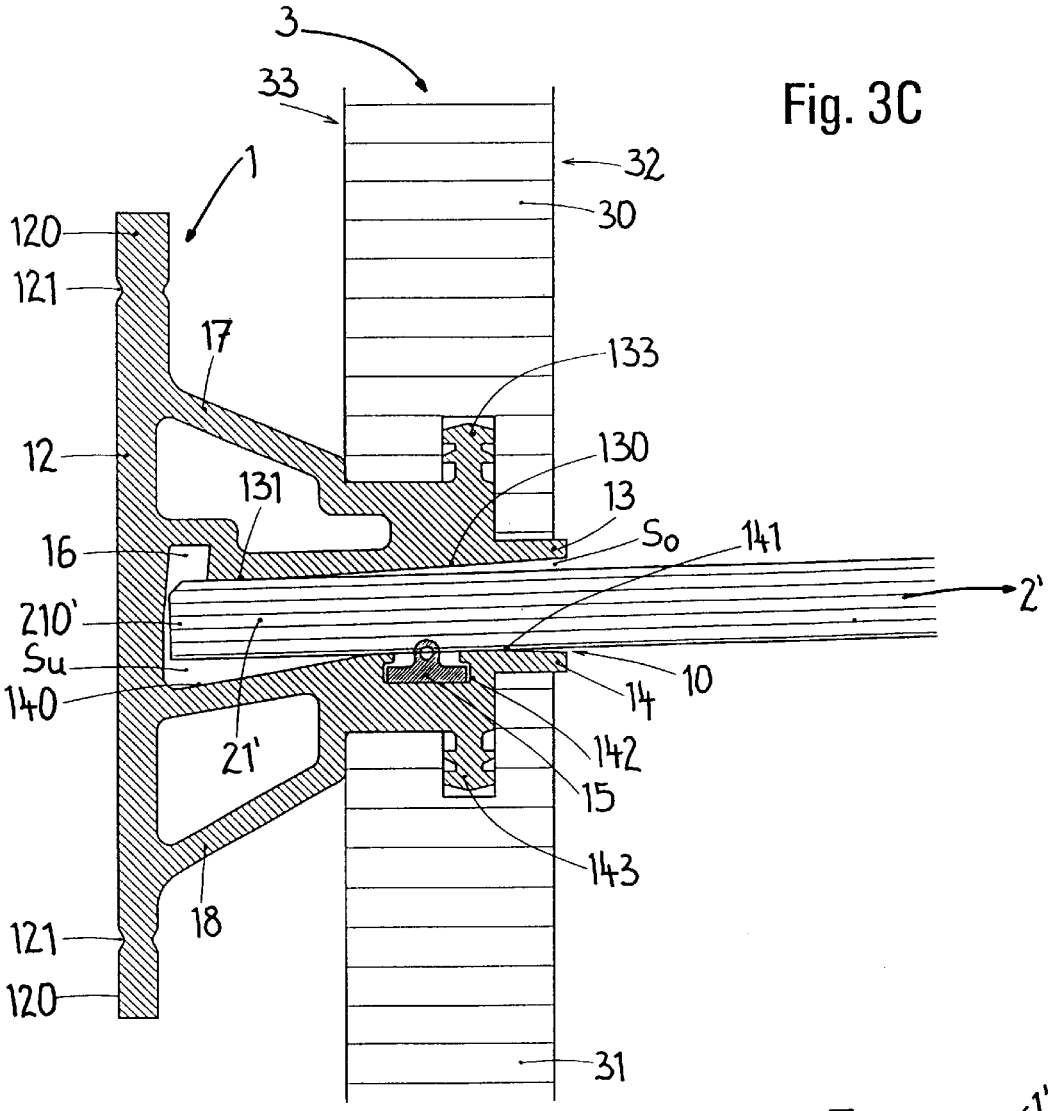
FIG. 3C shows the detail Y from FIG. 3B on an enlarged scale.

FIGS. 3A to 3C

As an alternative to the supporting arms 2, it is also possible for shelf-like supports 2' to be plugged into the passage 10 by way of their extended portions or rear borders 21' e.g. a glass panel. The rear edge 210' of the support 2' should then be pushed in until it strikes against the base plate 12, the undercut 16 remaining unoccupied. For the pushing-in operation, it is also necessary for the shelf-like support 2' to be raised at its front edge 201', with the result that the border 21' of the support 2' first of all pivots into the top; clearance $S_o$ and penetrates into the bottom clearance $S_u$ in order to pass the extruded profile 15. Once the support 2' has been pivoted down, said border 21' has its top side butting against the bearing means 131 of the top strut 13 and, at the same time, has its underside supported on the bearing means 141 of the bottom strut 14 and on the extruded profile 15. The extruded profile 15 causes increased static friction, with the result that the support 2' is additionally secured against sliding out of its own accord. An elastic polymer material, for example, is suitable for the extruded profile 15. For disengagement purposes, the panel-like support 2' should be raised slightly at the front edge 201' in order that the extruded profile 15 is moved out of contact with the support surface, but at least in order that the contact pressure decreases.

Figure 4A:
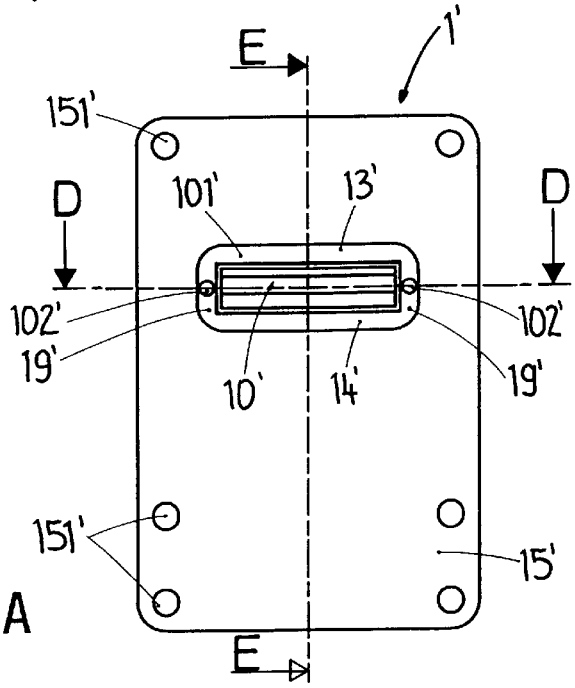
FIG. 4A shows a front view of a second embodiment of a plug-in mount, in the form of a housing.
Figure 6B:
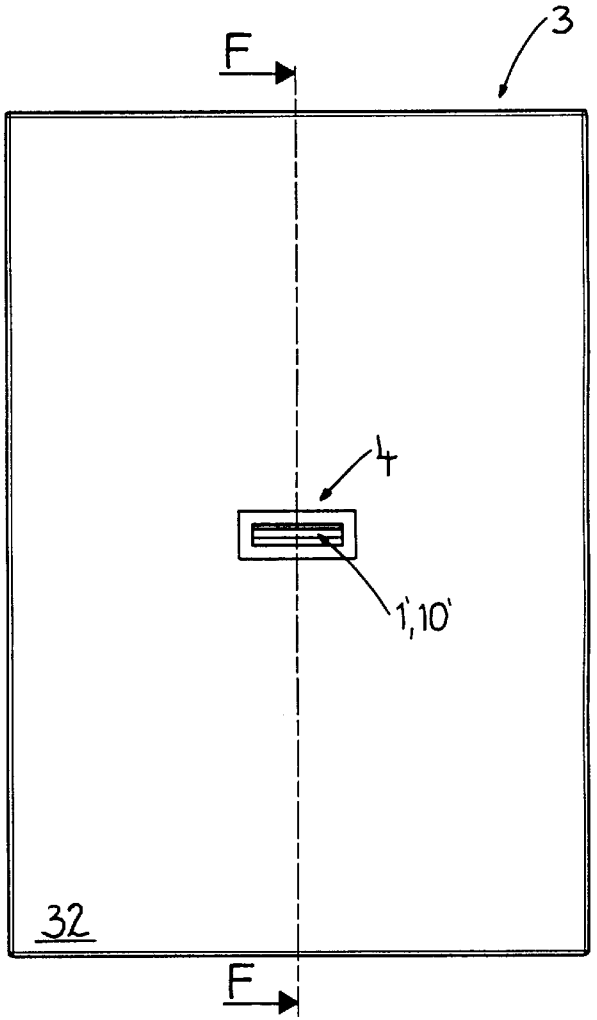
FIG. 6B shows a front view of the illustration according to FIG. 6A in the installed state.
Figure 6A:
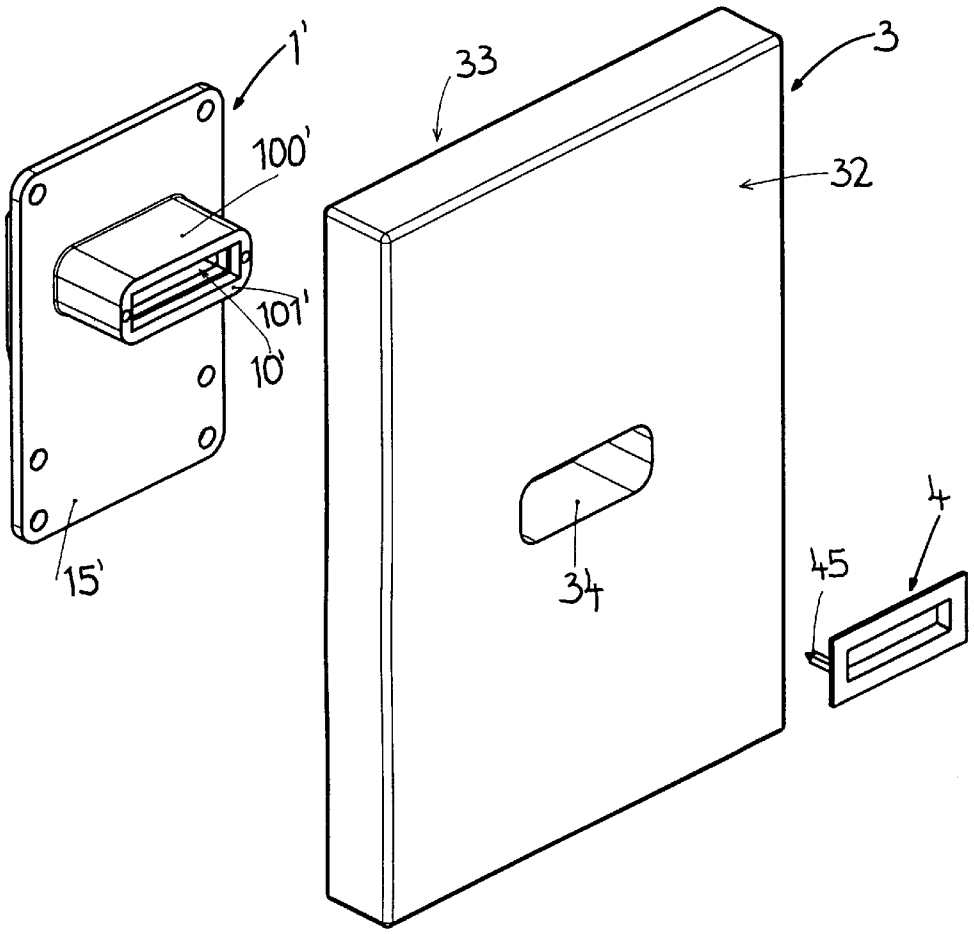
FIG. 6A shows an exploded illustration, in perspective, of the plug-in mount according to FIG. 4A and covering according to FIG. 5A with a supporting structure.

FIGS. 4A to 4C

In the second embodiment, the plug-in mount is in the form of a housing 1' into which the passage 10' extends from the front, from the inlet 11'. The passage 10' is bounded, once again, by a top strut 13', a bottom strut 14' and a rear base plate 12'. The base plate 12' extends to beneath the bottom strut 14' by way of its continuation 120'. In addition, two side flanks 19' are defined here between the struts 13',14', with the result that the passage 10'—in contrast to the profile rail 1—is also closed laterally. Provided, once again, on the top strut 13' are the upwardly oriented undercut 16', located adjacent to the base plate 12', the adjoining bearing means 131' and the upwardly sloping bevel 130', which runs to the inlet 11'. The top clearance $S_o$ is formed by said bevel. Located in the bottom strut 14' are the inclination 140', which slopes downward in the direction of the base plate 12' and has the bottom clearance $S_u$, and the adjoining bearing means 141', which runs to the inlet 11'. It is possible to dispense with the longitudinal groove and the inserted extruded profile in this case.

The housing 1' additionally has a planar positioning flange 15', which is intended for positioning on the rear side 33 of the supporting structure 3. Arranged upstream of the vertical positioning flange 15' in the direction of the inlet 11' is a considerable part of the passage 10', which is enclosed by the struts 13',14' and the side flanks 19', which produces a sleeve element 100' with the front edge 101'. From the front edge 101', two openings 102' in the form of blind holes extend into the side flanks 19'. A groove 103' runs round inside the sleeve element 100', directed toward the inlet 11' and adjacent to the front edge 101'. Provided on the rear side of the positioning flange 15' are two vertical guide ribs 150' which are spaced apart parallel to one another and could be utilized for reinforcing the housing 1' and possibly for accommodating a vertical support. A plurality of screw holes 151' are provided in the positioning flange 15' and serve for fastening on the rear side 33 of the supporting structure 3.

FIGS. 5A and 5B

A covering 4 is provided in order to cover over the front edge 101' of the sleeve element 100' of the housing 1' installed in a supporting structure 3, said covering comprising a rectangular frame 40 which runs round a window-like through-passage 41. The frame 40 is planar on the front side 42; on its rear side 43, an extension 44 encloses the through-passage 41. Furthermore, two pegs 45 extend from the rear side 43 of the frame 40, said pegs being designed to complement the openings 102' in the sleeve element 100'. The covering 4 will consist predominantly of plastic and will possibly be a colored injection molding.

FIGS. 6A to 6D

For the insertion of the housing 1', a through-passage opening 34 is provided in the supporting structure 3, and the sleeve element 100' is accommodated in said opening. The front edge 101' of the sleeve element 100' advantageously terminates in an approximately planar manner with the front side 32 of the supporting structure 3. The positioning flange 15' butts against the rear side 33 and is fastened, e.g. screwed, thereon. For visual purposes, the covering 4 is plugged onto the front edge 101' from the front side 32. In this case, the frame 40 covers over the front edge 101', the extension 44 of the covering 4 projects into the groove 103', and the pegs 45 latch in the openings 102' in the sleeve element 100'. The covering 4 is thus fixed and its through-passage 41 is located congruently with the inlet 11 into the passage 10'.

Figure 7A:
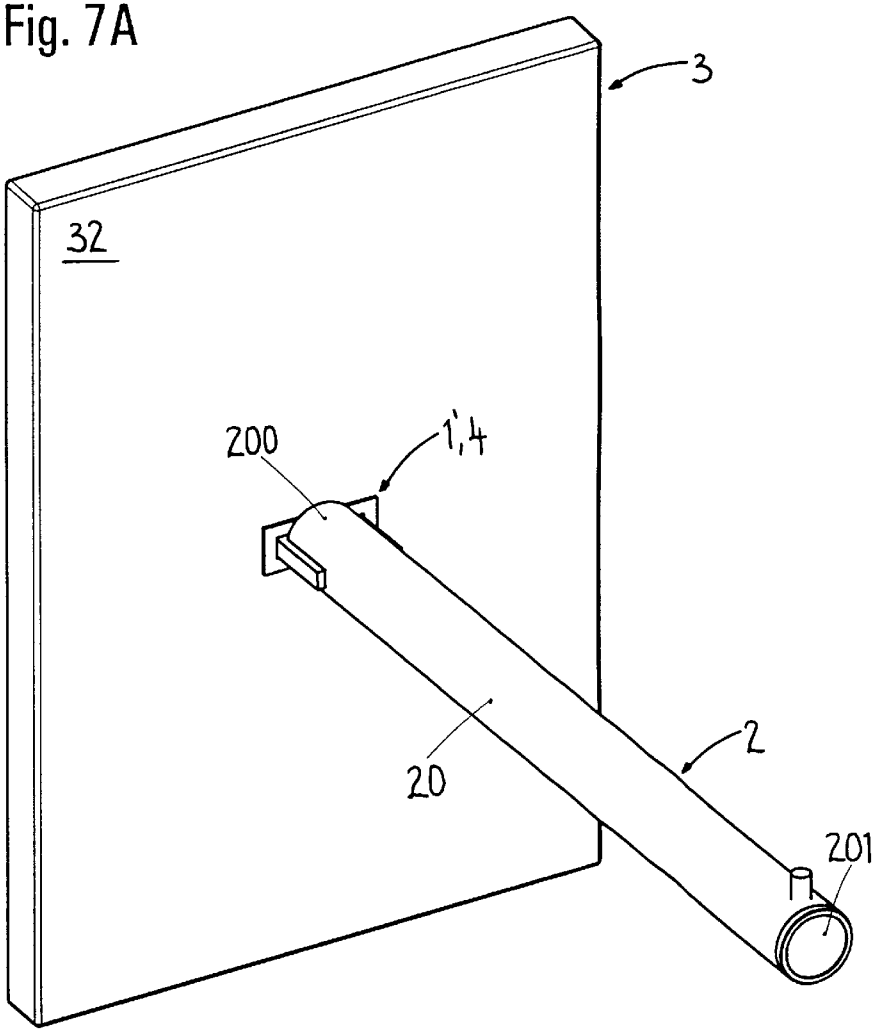
Figure 7B:
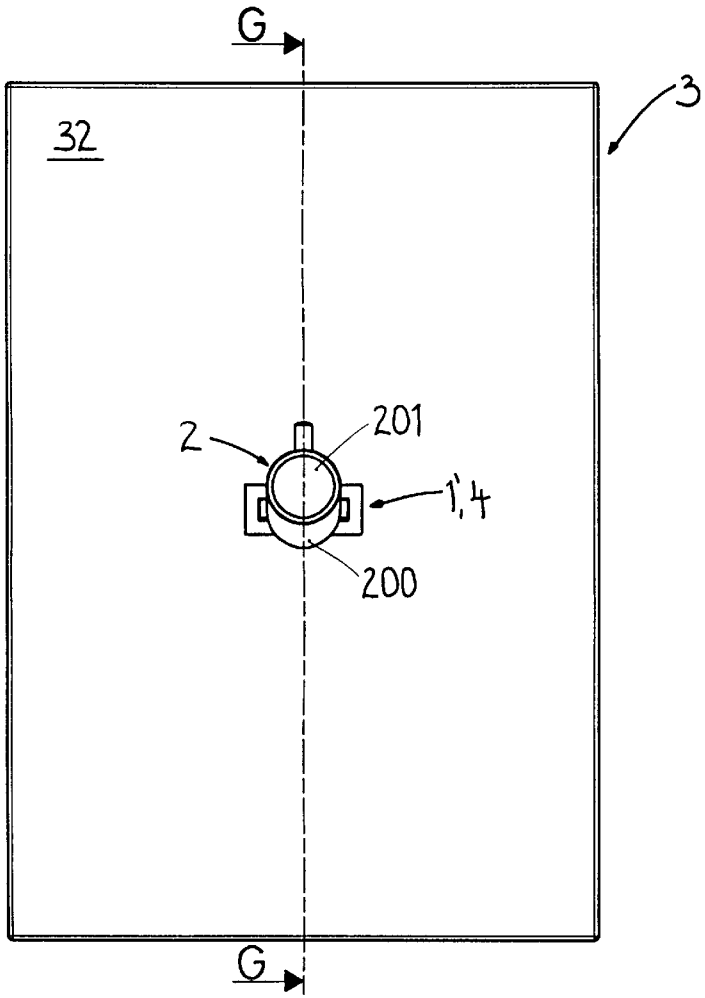
FIG. 7B shows a front view of the illustration according to FIG. 7A.
Figure 7C:
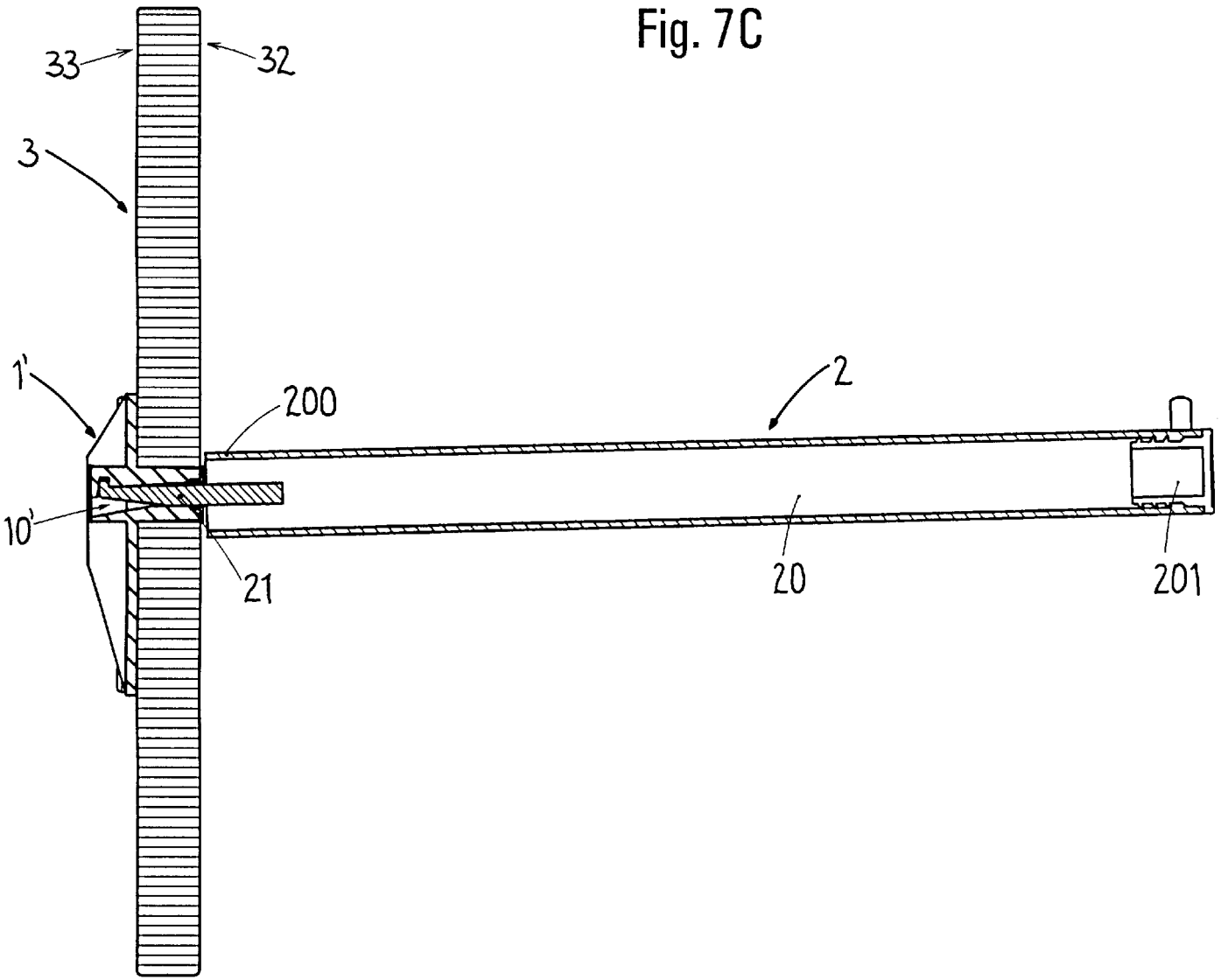
FIG. 7C shows an enlarged illustration according to FIG. 7B in section along line G—G.

FIGS. 7A to 7C

The housing 1', which is inserted into the supporting structure 3 and has the optional covering 4, is suitable for accommodating, in its passage 10', a support 2 which has been described above in FIGS. 2A to 2C and has a tongue 21 of complementary shape and the hook 23. In this case, however, the operation of plugging the support 2 in is tied to the point where the housing 1' is installed. The movement sequence of plugging in and removing the support 2 remains unchanged. In the plugged-in state, the hook 23 engages, once again, in the undercut 16'. The form fit of the tongue 21 in the passage 10' also causes the plugged-in support 2 to be positioned in a rotationally fixed manner. The possibilities of positioning the plugged-in support 2' at any desired location or displacing it transversely are logically ruled out as a result of the support being plugged in at just a single point.

It is possible to realize further design variations in respect of the embodiments described above, and the following should be expressly mentioned here:

It is possible to provide a fastening contour on the rear side of the housing 1', preferably between the guide ribs 150' or on the base plate 12', in order to render straightforward the operation of fixing the housing 1' with the supporting structure 3 on a rear structure—e.g. a building wall. Examples of a possible fastening contour here are a hook, an eyelet or a link plate with a screw hole. It would be advantageous for the fastening contour to be arranged on the continuation 120', which is freely accessible in the direction of the positioning flange 15'.

It is also possible, in the case of the profile rails 1, just to provide stops instead of the tongue extensions 133,143 and, the panels 30,31 provided with complementary grooves 301,311, panels being positioned on said stops, and fastened—e.g. screwed—thereon, from the front.

If it is intended, for example, to construct a complex display wall, it is possible for a plurality of spaced-apart profile rails 1 to be arranged horizontally within a supporting structure 3. A plurality of supporting arms 2 which are independent of one another may be fitted into a profile rail 1. It is also possible for two or more supporting arms 2 to be coupled to one another by cross-connectors and for this to be fitted in as an arm structure. In the case of vertical connectors between supporting arms 2, such an arm structure engages over a plurality of profile rails 1 arranged one above the other and is fitted therein.

In order to achieve a variable fitted-out arrangement, it is possible for a plurality of housings 1' to be arranged systematically on a supporting structure 3, possibly in addition to any profile rails present.

The shelf-like supports 2' may be planar or provided with various additions such as a surround, holder or supporting bar. Such supports 2' may be formed not just by panels, but also by grilles or combinations thereof. The important factor is that they have a solid rear border 21', which may or may not be continuous and can be fitted into the passage 10, securing the support 2' in position. The possibilities of any desired positioning and displacement along a profile rail 1 are also provided by shelf-like supports 2'.

With the design possibilities arising being utilized in combination, it is possible for a plurality of profile rails 1 to be inserted, as plug-in mounts, for example on a first, rearmost supporting structure 3. Said profile rails 1 may be fitted with supporting arms 2 and shelf-like supports 2'. Via supporting arms 2, it would be possible for a second supporting structure 3, arranged in front, to be secured in a displaceable manner, this supporting structure serving, for its part, for accommodating further plug-in mounts in the form of profile rails 1 or housings 1'. Such a second supporting structure 3 would also be conceivable in shop construction as a display panel, once again with fittings, as a mirror surface without fittings, or as a screen.

We claim:

1. An arrangement for hanging and displaying articles, comprising a plug-in mount (1,1'), which is inserted into a supporting structure (3), and a support (2,2') having an extended portion which is plugged into the plug-in mount (1,1'), wherein the plug-in mount (1,1') is a horizontally fitted profile rail (1) and has a front inlet (11,11'), a rear boundary (12,12') and a passage (10,10') which extends therebetween, the passage (10,10') having a bevel (130, 130') at its top, which slopes upward, in the direction of the inlet (11,11'), thereby forming a top clearance ($S_o$), an inclination (140,140') at its bottom, which slopes downward, in the direction of the rear boundary (12, 12'), thereby forming a bottom clearance ($S_u$), and an undercut (16,16') at its top, which is proximate to the rear boundary (12,12') and in communication with the inlet (11,11')

the profile rail (1) having a longitudinal groove (142), which is provided in the bottom of the passage (10) of the profile rail (1), and an extruded profile (15), which is positioned in and extends out of the longitudinal groove (142) as a slipping-prevention means, the extended portion of the support (2) being rested on the extruded profile (15), the profile rail (1) including a top strut (13), a bottom strut (14) and a base plate (12) as the rear boundary (12) all of which cooperate to form the passage (10) of the profile rail (1), the top strut (13) including the undercut (16), which is positioned therein, a bearing means (131), which is positioned intermediate of the undercut (16) and the inlet (11), and the upwardly sloping bevel (130) with the too clearance ($S_o$) located therebeneath both of which are positioned adjacent to the inlet (11), the bottom strut (14) including the inclination (140), with the bottom clearance ($S_u$) located thereabove, and a bearing means (141) which is arranged adjacent to the inlet (11) and having the longitudinal groove (142), the top and bottom struts (13,14) being affixed to the base plate (12), the profile rail (1) being attached to the supporting structure, which includes a front side (32), the top and the bottom struts (13,14) extending approximately the width of the front side (32), each of the top and bottom struts having a tongue extension (133,143) that projects perpendicularly therefrom, the tongue extensions (133,143) being adapted so as to be securely received in grooves (301,311) which are provided in the supporting structure (3), the top strut (13) including an upper supporting strut (17) which affixes the top strut (13) to the base plate (12);

the bottom strut (14) including an lower supporting strut (18) which affixes the bottom strut (14) to the base plate (12), a top cavity is being formed between the top strut (13) and the upper supporting strut (17), a bottom cavity is being formed between the bottom strut (14) and the lower supporting strut (18), the top and bottom struts (13,14) widening conically toward the vertical base plate (12), and continuations (120) being provided on both sides of the base plate (12) that extend beyond the top and bottom struts (13,14).

2. The arrangement as claimed in claim 1 wherein the continuations (120) each have a notch line (121) for locating a suitable position for optional screw holes which are adapted for fastening a supporting structure (3), having at least one profile rail (1) attached thereto, to an additional supporting structure.

3. The arrangement as claimed in claim 1 wherein the extended portion of the support (2) is at least one tongue (21) and the support (2) has an upwardly directed hook (23) which is adapted to be engaged in the undercut (16,16').

4. The arrangement as claimed in claim 3 wherein the tongue (21) of the support (2) has an upwardly directed hook (23) at one end;

a tongue stem (22) having a bottom extends from the hook (23) to the support (2);

a tapered portion (220) which runs obliquely upward toward the hook (23) is provided at the bottom of the tongue stem (22); and the tongue (21) consists of flat material of rectangular cross section.

5. The arrangement as claimed in claim 4 wherein the support (2) includes a supporting arm having a bar part (20) with a base end (200); and the tongue stem (22) merges into the base end (200) of the bar part (20).

6. The arrangement as claimed in claim 1 wherein the support (2') is a shelf and the extended portion thereof is a rear border (21') adapted for plugging into the passage (10) of the profile rail (1).

7. The arrangement as claimed in claim 6 wherein the support (2') is a planar panel.

8. The arrangement as claimed in claim 7, wherein the planar panel (2') is made of wood.

9. The arrangement as claimed in claim 7, wherein the planar panel (2') is made of plastic.

10. The arrangement as claimed in claim 7, wherein the planar panel (2') is made of metal.

11. The arrangement as claimed in claim 7, wherein the planar panel (2') is made of glass.

12. The arrangement as claimed in claim 1 wherein the extruded profile (15) is elastic.

13. The arrangement as claimed in claim 1 wherein the tongue extensions (133,143) of the top and bottom struts are stop edges for positioning the supporting structure against them and fastening the supporting structure thereto.

14. [The arrangement as claimed in claim 9, wherein] An arrangement for hanging and displaying articles, comprising a plug-in mount (1,1'), which is inserted into a supporting structure (3), and a support (2,2') having an extended portion which is plugged into the plug-in mount (1,1'), wherein the plug-in mount (1,1') is a housing (1') and has a front inlet (11,11'), a rear boundary (12,12') and a passage (10,10') which extends therebetween, the passage (10,10') having a bevel (130,130') at its top, which slopes upward, in the direction of the inlet (11,11'), thereby forming a top clearance ($S_o$), an inclination (140,140') at its bottom, which slopes downward, in the direction of the rear boundary (12, 12'), thereby forming a bottom clearance ($S_u$), and an undercut (16,16') at its top, which is proximate to the rear boundary (12,12') and in communication with the inlet (11,11'), the housing (1') including a top strut (13'), a bottom strut (14'), side flanks (19') extending between the top and bottom struts (13',14') and a base plate (12') as the rear boundary (12') all of which cooperate to form the passage (10) of the housing (1'), the top strut (13') including the undercut (16'), a bearing means (131'), which is positioned intermediate of the undercut (16') and the inlet (11'), and the upwardly sloping bevel (130') with the top clearance ($S_o$) located therebeneath both of which are positioned adjacent to the inlet (11), the bottom strut (14') including the inclination (140'), with the bottom clearance ($S_u$) located thereabove, and a bearing means (141'), which is located adjacent to the inlet (11'), the supporting structure (3) having a front side (32) and a rear side (33), the top and the bottom struts (13',14'), together with the side flanks (19'), forming a sleeve element (100') which, when inserted into a throuqh-passage opening (34) of a supporting structure (3), extends approximately as far as the front side (32) of the supporting structure (3), the housing (1') further including a positioning flange (15') which is positioned proximate to the sleeve element (100') and adapted for abutting against the rear side (33) of the supporting structure (3), the positioning flange (15') having screw holes (151') for fastening on the rear side (33) of the supporting structure (3), the positioning flange (15') including a rear side having ribs (150') for reinforcement, and the sleeve element (100') including a front edge (101') having openings (102'), and in the passage (10'), inside the front edge (101'), a groove (103') being provided for attaching covering (4) thereto.

15. The arrangement as claimed in claim 14 wherein the covering (4) includes a rectangular frame (40) which borders a window-like through-passage (41) which is congruent with the inlet (11'), the frame (40) being planar on its front side (42) and adapted to cover the front edge (101') of the sleeve element (100') when the covering is positioned on the front side (32) of the supporting structure (3), a rear side (43) with an extension (44) that encloses the through-passage (41) and ends in the groove (103'); and two pegs (45) which each extend from the rear side (43) of the frame (40) and are adapted to be latched into the openings (102') in the sleeve element (100').

16. The arrangement as claimed in one of claims 14 or 15 wherein the covering (4) is a plastic injection molding of any desired color.

17. The arrangement as claimed in claim 14 wherein a fastening element is provided on the positioning flange (15').

* * * * *